US005395174A

United States Patent [19]

Koch et al.

[11] Patent Number: 5,395,174

[45] Date of Patent: Mar. 7, 1995

[54] APPARATUS FOR PRINTING LABELS

[75] Inventors: Ulf Koch, Eberbach; Peter Schneider, Neckargemünd, both of Germany

[73] Assignee: Esselte Meto International GmbH, Heppenheim, Germany

[21] Appl. No.: 229,518

[22] Filed: Apr. 19, 1994

[30] Foreign Application Priority Data

Apr. 19, 1993 [DE] Germany ..... 43 13 013.5

[51] Int. Cl.[6] ..... B41J 11/26; B65C 11/02

[52] U.S. Cl. ..... 400/611; 400/614; 156/384

[58] Field of Search ..... 400/611, 614, 621; 101/288, 291, 293; 156/384, 385, 386, 387, 388, 538, 556, 355–357, 358

[56] References Cited

U.S. PATENT DOCUMENTS

| | | | |
|---|---|---|---|
| 3,616,050 | 10/1971 | Schrutz | 156/358 |
| 3,664,222 | 5/1972 | Early | 156/357 |
| 3,890,188 | 6/1975 | Sams | 156/384 |
| 3,984,279 | 10/1976 | Siryj | 156/556 |
| 3,989,575 | 11/1976 | Davies et al. | 156/355 |
| 4,120,245 | 10/1978 | Karp et al. | 400/614 |
| 4,261,788 | 4/1981 | McClung | 156/541 |
| 4,440,592 | 4/1984 | Sato et al. | 101/288 |
| 4,473,426 | 9/1984 | Goodwin et al. | 156/384 |
| 4,734,713 | 3/1988 | Sato et al. | 400/611 |

FOREIGN PATENT DOCUMENTS

| | | |
|---|---|---|
| 1927163 | 8/1970 | Germany . |
| 7808394 | 10/1979 | Germany . |

*Primary Examiner*—Eugene H. Eickholt
*Attorney, Agent, or Firm*—Thomas N. Ljungman

[57] ABSTRACT

An apparatus for printing labels can have a printing area, a deflector area designed as a shaft or an edge located behind the printing area in the transport direction of the labels, around which deflector the carrier strip can be guided, and where the labels, on account of their stiffness, can be detached from the carrier strip, while the adhesive glue remains on the underside of the label. In addition, the printing apparatus can also have a supporting apparatus with a contact area near the output opening for the labels, against which supporting area the labels, output via the output opening, come into contact with their underside. The contact area of the support apparatus can preferably be formed by the exposed surfaces of balls mounted so that they can rotate in at least one retaining strip, so that during the label output, the labels preferably do not stick to the support apparatus, as such sticking would significantly interfere with the output of the labels.

17 Claims, 7 Drawing Sheets

APPARATUS FOR PRINTING LABELS

BACKGROUND OF THE INVENTION

1. Field of the Invention

This invention generally relates to an apparatus for printing labels detachably glued to a carrier strip by means of an adhesive on the underside of the label, or the side adjoining the carrier strip. Such a printing apparatus can have a printing area for printing information, such as pricing information, onto the labels. In addition, there can also be a deflector area located behind the printing area in the transport direction of the labels. Such a deflector area can be configured in the form of a shaft, roller, or an edge, around which the carrier strip can be guided, and can be configured such that the labels can be detached from the carrier strip on account of the stiffness of the label, with the adhesive remaining on the underside of the label. After the deflector area, located in the transport direction of the labels, there can be an output, opening through which the labels can pass out of the printing apparatus. Further, there can also be a support apparatus with a contact area, for receiving the labels which have been detached from the carrier strip and have been output from the printing apparatus through the output opening. This contact area can essentially be configured as a holding area for holding a printed label wherein the adhesive underside of the labels comes into contact with the contact area and is adhered thereto.

2. Background Information

Known stationary label printers which are equipped to print individual labels, have a contact device which is located near the output opening for the labels. The labels printed and output via the output opening come into contact with the contact device. The labels can then be removed from the contact device by hand, and can be area-glued to an item to be labelled. Since the adhesive required for this purpose is on the underside of the labels, the labels frequently adhere too strongly to the contact area of the contact device during the output, before they have been completely transported out of the output opening. This results in a significantly adverse effect on the output of labels, as the labels can possibly jam the printer device.

OBJECT OF THE INVENTION

The object of the present invention is to create a contact device for a label printer, which could be a stationary label printer, which label printer can be suitable for the printing and the output of individual labels, and which label printer is configured such that the afore-mentioned disadvantages of the label output of known printers can be substantially eliminated.

SUMMARY OF THE INVENTION

The present invention teaches that this object can be achieved if the contact area of the support apparatus is preferably formed by the exposed surfaces of a plurality of balls. The balls can preferably be mounted in at least one retaining strip so that the balls can preferably be free to rotate in the at least one retaining strip. Since the glued underside of each of the printed labels will essentially come into contact with hardly more than one point of the surfaces of the balls, the adhesive forces between the surfaces of the balls and the underside of the label can be kept substantially minimal. Thus, during the output of labels from the printing apparatus, essentially all that happens is that the balls are set in rotation. Interference with the transport of the labels can thereby be substantially largely eliminated.

The support apparatus with the contact area which is formed by the exposed surfaces of the balls, mounted rotatably in a retaining strip, can preferably be realized in a very simple and economical manner. One way in which the support apparatus can be realized is by preferably using an injection molding process. In essence, an injection molding process could be used if the at least one retaining strip has a U-shaped cross section, with elastic legs of the U-shaped brackets located on a crossbar. Also, the distance between the legs of the "U" should preferably be less than the diameter of the balls, and the holes for receiving the balls should preferably be disposed opposite to one another and should preferably be configured to have a radius which is smaller than the radius of the balls. In addition, the distance of the legs of the "U" from one another and the location and the radius of the holes can preferably be selected so that, between each pair of two opposite holes, a ball can be supported in a manner such that a first distance between the crossbar and at least a portion of the exposed surface of the balls facing away from the crossbar is greater than a second distance between the crossbar and the end surfaces of the legs of the U-shaped brackets facing away from the crossbar.

Preferably, in one embodiment of the invention, at least two of the-above-discussed retaining strip/ball arrangements can be provided as the contact device, with the at least two strips being oriented with the longitudinal dimension thereof disposed in the transport direction of the labels. Labels which lie on a support apparatus having at least two such retaining strips of balls, can then essentially be easily grasped and removed from the support apparatus.

Retaining strips and balls made of plastic can be economically manufactured by using an injection molding process as indicated above, or alternatively, by using a manufacturing method which involves cutting or machining. Compared to conventional steel balls, balls made of plastic also tend to have a very much lower moment of inertia, which can result in a further reduction of the interference with the output of the labels. Finally, the legs of a U-shaped brackets of a retaining strip made of plastic, will also generally have an elasticity such that the retaining strips and balls can b easily assembled together, by pressing the balls from above into the retaining strip in the vicinity of the holes.

The adhesive forces between the surfaces of the balls and the underside of the labels coated with adhesive can be further reduced if the balls are preferably made of a plastic which does not stick to the adhesive, or if the balls are at least externally coated with such a plastic. One such type of plastic which has a minimal adhesion to adhesives includes polytetrafluoroethylene (PTFE), such as is sold and marketed under the name of "TEFLON". If the retaining strips are made of a material which has only a low frictional resistance to the rotational movements of the balls, or possibly at least coated with such a material, smooth output of the labels can be achieved, even when particularly thin and flexible labels are being printed. One such type of material from which the retaining strips could be manufactured includes polyoxymethylene, for example.

In alternative embodiments of the invention, the strips could also be made from polytetrafluoroethylene.

Another possible material from which the balls and/or retaining strips could be made includes low-melting perfluorinated copolymers of tetrafluoroethylene (TFE) and hexafluoropropylene (HFP). Other possible materials include copolymers of ethylene with tetrafluoroethylene, and perfluorovinyl ethers with tetrafluoroethylene. Such compounds are typically classified as "flouroplastics".

In summary, one aspect of the invention resides broadly in a apparatus for printing labels, the labels having a first side thereof at least partially coated with adhesive and the labels being detachably glued by means of the adhesive to a carrier strip. The apparatus comprises: a printing area for printing the labels; a deflector area located behind the printing area in a transport direction of the labels, in the form of a shaft or an edge, around which the carrier strip can be guided, and where the labels can be detached from the carrier strip on account of their stiffness, whereby the adhesive remains on the underside of the label; an output opening for the labels located behind the deflector area in the transport direction of the labels, and with a support apparatus with a contact area, with which the labels detached from the carrier strip and output via the output opening come into contact by means of their underside, characterized by the fact that the contact area of the contact device is formed by the exposed surfaces of balls mounted so that they can rotate in at least one retaining strip.

Another aspect of the invention resides broadly in an apparatus for printing labels, the labels having a first side thereof at least partially coated with adhesive. The apparatus comprises: label supply apparatus for supplying labels to be printed; apparatus for printing the labels; apparatus for feeding labels from the label supply apparatus to the printing apparatus; apparatus for receiving printed labels from the printing apparatus; and apparatus for transporting printed labels from the printing apparatus to the receiving apparatus. The apparatus for transporting defining a path of transport from the printing apparatus to the receiving apparatus and the transport path defining a direction of transport. The receiving apparatus comprises: a plurality of balls, the balls comprising a material having minimal adhesion characteristics to the adhesive; apparatus for rotatably mounting each of the plurality of balls in an area after the printing apparatus in the direction of transport of the printed labels; and at least one of the plurality of balls being disposed for contacting adhesive of the first side of a printed label for retaining a printed label.

BRIEF DESCRIPTION OF THE DRAWINGS

Further embodiments of the invention are explained in greater detail below with reference to the accompanying figures, in which.

DESCRIPTION OF THE PREFERRED EMBODIMENT

Figure 1:
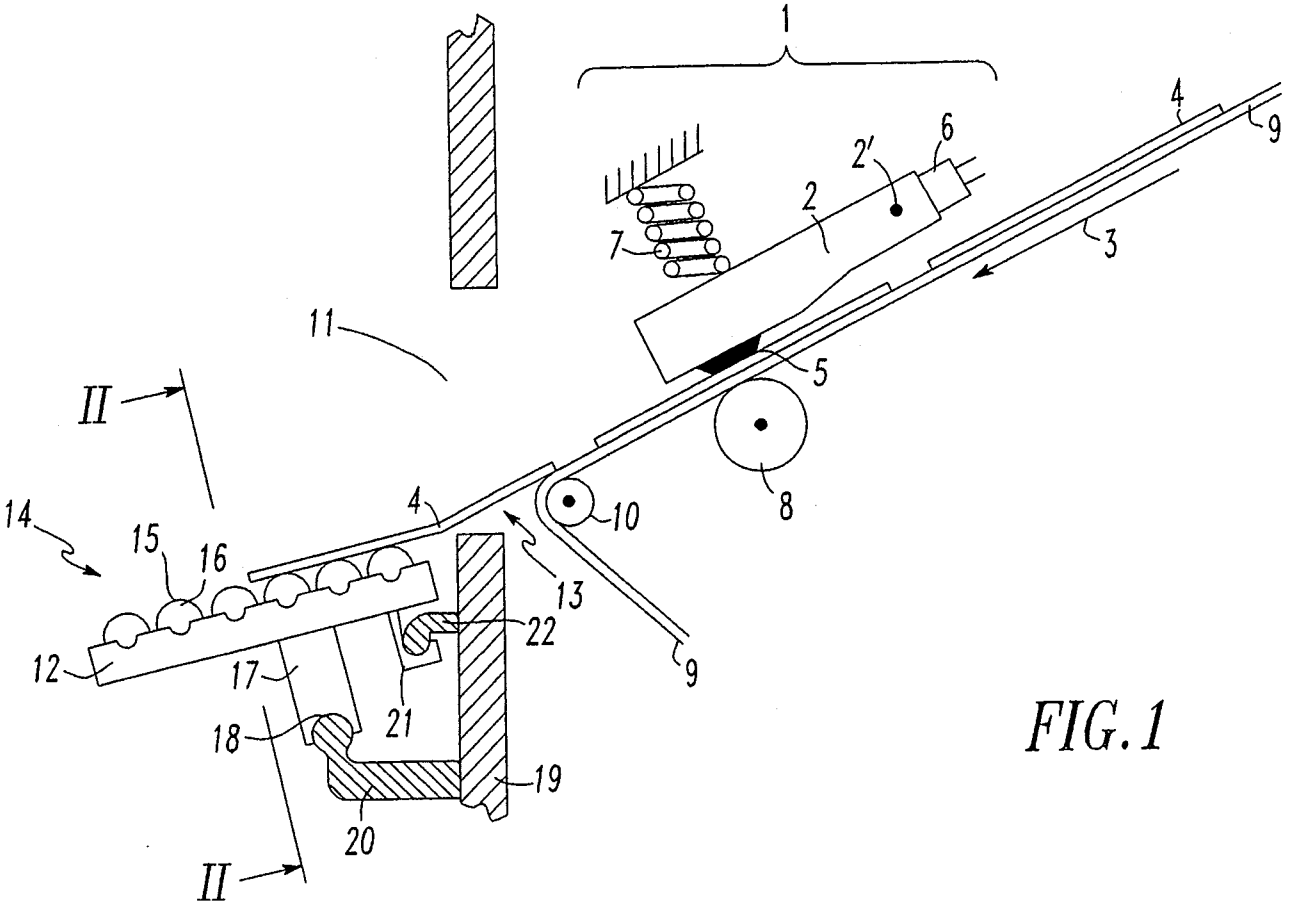
FIG. 1 illustrates the printing area of a thermal printer with the output opening and the support apparatus.

In one possible embodiment of the present invention, as illustrated in FIG. 1, a label printing device having a thermal print head 2 can be provided with a contact area in accordance with the present invention. Alternatively, essentially any type of label printing device, including laser printing devices, ink transfer printing devices, etc. could be provided with a contact area in accordance with the present invention. In essence, the contact area in accordance with the present invention can preferably be used for printing on labels with adhesive already applied thereto, but could also be used for labels which may be given adhesive in a later processing stage, or possibly for labels which will not receive any adhesive at all.

A thermal printer as illustrated in FIG. 1 can preferably have a printing area 1 which can comprise the thermal print head 2. The thermal print head 2 can preferably be mounted so that it can rotate on a shaft 2', and can preferably have a row of individual electrically actuated heater elements 5, which can preferably be arranged in a straight row, and can be oriented at right angles to the transport direction 3 of labels 4. For a thermal printer, such as the one depicted in FIG. 1, the labels 4 can preferably be made of temperature-sensitive paper, or paper impregnated with an ink which becomes visible upon application of heat thereto. The heater elements 5 can preferably be actuated by means of a connector 6 from a central control unit 40, as shown in FIG. 1A.

The thermal print head 2 can also be provided with a biasing device, such as a spring 7, under compression, by means of which the thermal print head 2 can be pressed against the labels 4 to be printed. A counterpressure roller 8 can preferably produce the counterpressure necessary for this purpose.

Alternatively, a simple pressure plate or table 8', shown in FIG. 1A, disposed directly below the labels and carrier paper 9, could be used to provide a surface on which the labels can be printed. In other words, the print head 2 could preferably press the labels 4 and carrier paper 9 onto the counterpressure roller 8 or pressure plate 8', to thereby achieve goo, contact between the thermal print elements 5, and the labels 4.

Figure 1A:
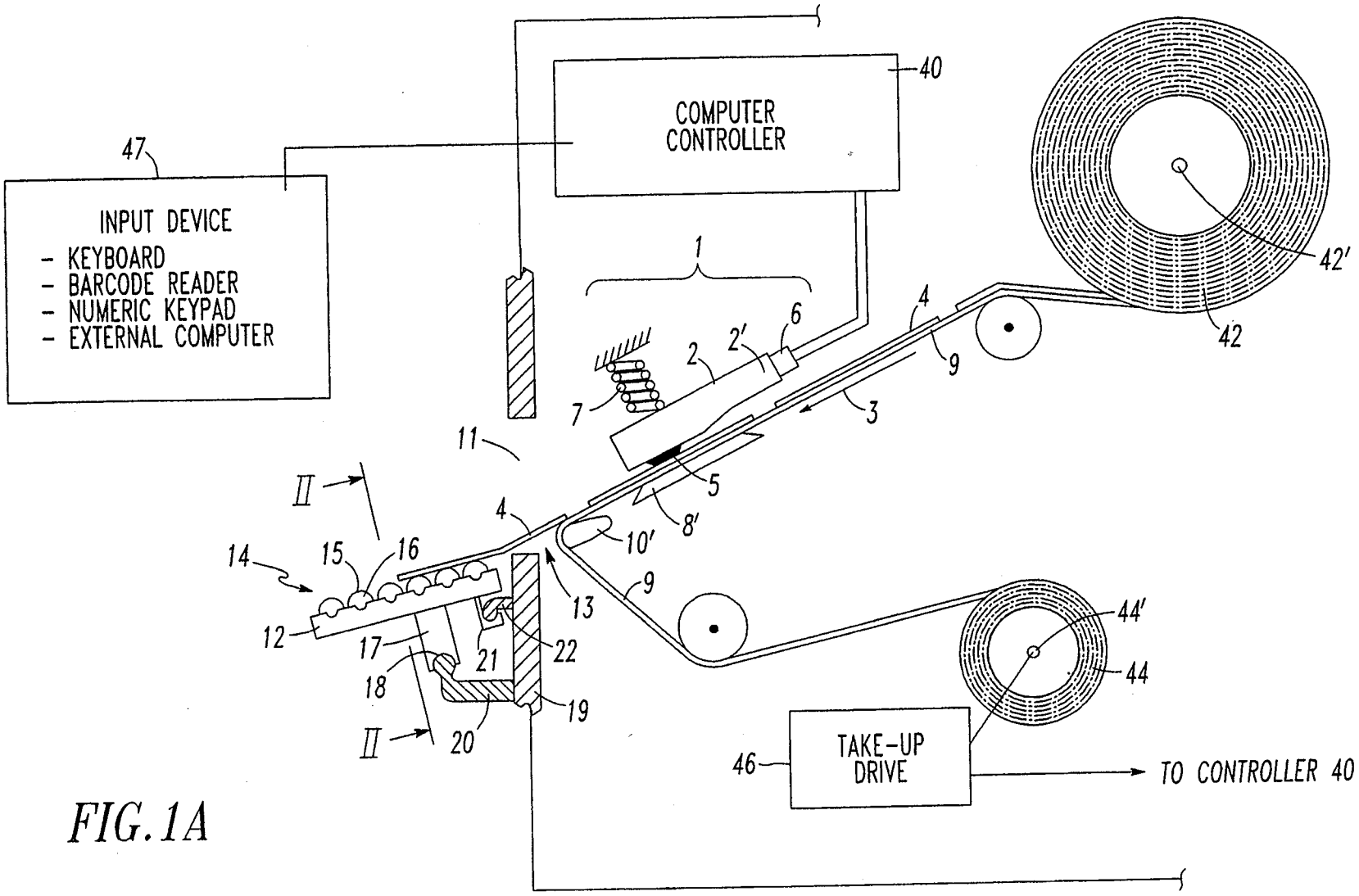
FIG. 1A illustrates a similar view of a thermal printer as shown in FIG. 1, but with additional details.

As depicted in FIG. 1A, the labels 4 can preferably be provided from a label roll 42 which can be free to rotate about a shaft 42'. An additional roller 44' about which the used carrier paper or strip 9 can be wound to form a used roll 44, can also be provided in the printer apparatus. In one possible embodiment of the present invention, this additional shaft 4' can be a driven shaft which is driven by a motor 46 controlled by the control device 40. This shaft 44' can thereby serve a the take-up device which pulls the labels through the printing area 1. Alternatively, other types of drive devices could be used in place of the driven shaft 44' and substitution therefor would be well within the skill of the artisan.

The labels 4 can preferably be fixed by means of an adhesive glue to the carrier strip 9, which strip can be made of paper. To preferably enable the labels 4 to be removed from the carrier strip 9, the side of the carrier strip 9 facing the labels 4 can preferably be coated with silicon, or another type of substance which will have minimum adhesion to the adhesive on the labels 4. Silicon will typically adhere to the adhesive very much less than does the paper of which the labels are made, for example, which means that the labels 4 can essentially be easily detached from the carrier strip 9 and the adhesive can thereby remain on the labels 4.

As best illustrated in FIG. 1A, as the labels are unwound from the roll 42, and after having passed the printing area 1, the removal of the labels 4 from the carrier strip 9 can preferably be accomplished by guiding the carrier strip 9 around a shaft, or roller 10. The shaft or roller 10 can preferably be of a small radial diameter to thereby form a deflector area. Thus, on account of the stiffness of the labels 4, the labels 4 will generally not be able to execute the sharp bend executed by the carrier strip 9, and the labels 4 will preferably become detached from the carrier strip 9.

Alternately, as depicted in FIG. 1A, instead of a roller 10, an edge of a plate 10', which could alternatively be an edge of the plate 8', could be provided to function as the deflector area.

As shown in FIG. 1, behind the printing area 1 and behind the deflector area 10 in the direction of transport 3 of the labels 4, there can preferably be an output opening 11 for the detached labels 4 to pass through. There can also preferably be a support apparatus 12 against which the labels 4, detached from the carrier strip 9 and output via the output opening 11, can preferably come into contact with their underside 13, which underside 13 is coated with the adhesive glue. The labels 4 can preferably come into contact by means of their underside 13 with a contact area 14 of the support apparatus 12, which contact area 14 can preferably be formed by the exposed surfaces 15 of balls 16 mounted so that they can rotate.

The support apparatus 12 can preferably have, on its underside, an arm 17, worked into the end surface of which can preferably be a recess 18. During the assembly of the support apparatus 12, the end of a projection 20 located on the outside of the printer housing 19 can be snapped into the recess 18. To stabilize the support apparatus 12, the support apparatus 12 can also preferably be provided with a hook-shaped bracket 21 which can preferably be engaged in an additional lug-shaped projection 22 of the housing 19 and thereby preferably prevent the support apparatus 12 from tipping forward.

This arrangement of arm 17 and bracket 21, essentially enables the support apparatus 12 to be removably attached to the printer housing 19. This can be advantageous for cleaning the support apparatus 12, after a predetermined period of time, or after an operator notices that the balls 16 may not be freely rotating, possibly due to a build-up of adhesive within the support apparatus 12. In the depicted embodiment, the operator would essentially only have to lift up on the front end of the support apparatus 12, thereby disengaging the arm 17 from the projection 20. The bracket 21 at the back end of the support apparatus 12 could then simply be unhooked from the projection 22, and the support apparatus could be pulled away from the housing 19 for cleaning or replacement. A reverse procedure could then be followed for reconnecting a support apparatus 12 back to the housing 19. In addition, such a bracket arrangement can also allow for substitution of various support apparatuses 12 which could have different widths or lengths to correspond to different sizes of labels being printed.

During the transport of the labels 4 in the direction indicated by the arrow 3, the heater elements 5 in contact against the labels 4 can be individually electrically actuated as a function of the image to be printed, so that the heater elements 5 can produce a sufficient quantity of heat to cause a local coloration of the temperature-sensitive labels 4. After the printing of the labels 4, the carrier strip with the labels 4 can be further transported and guided around the shaft 10. This movement around the shaft 10 preferably bends the carrier strip 9 sharply enough that the labels 4 become detached from the carrier strip 9 and output from the housing 19 by sliding out via the output opening 11.

The heater elements 5 can preferably be controlled by the control device 40, see FIG. 1A, as a result of previously input control instructions. In this sense, an operator can program the control device 40 by inputting instructions into the control device 40 by means of an appropriate input device 47. As shown in FIG. 1A, this input device 47 can be a keyboard for entering typed instructions, or possibly a barcode reader for possibly reading in a particular barcode indicative of 8 set of instructions to be carried out. A simple numeric keypad could also be provided for selecting instructions, etc., or inputting numerical data, such as pricing information, or reference numbers etc. As shown in FIG. 5B, one possible embodiment of a printing apparatus in accordance with the present invention can also preferably be provided with at least one type of computer connection device, such as an RS-232 port 57, a parallel interface 56, a PCMCIA slot 58, a pin connector 59, etc, for connecting the printing apparatus with an exterior computer (not shown) to thereby instruct the printing apparatus by means of the external computer.

Returning now to the embodiment shown in FIGS. 1 and 1A, after the labels 4 have passed out of the opening 11, the labels 4 can preferably come into contact by means of their underside 13, which is coated with the adhesive glue, against the exposed surfaces 15 of the balls 16 which are preferably mounted to rotate in the support apparatus 12. The movement of the labels 4 along the balls 16 can preferably place the balls in rotation, to thereby carry the label away from the opening 11.

Since the labels 4 come into contact with only a very small area of the exposed surfaces 15 of the balls 16, the adhesive glue on the underside 13 of the labels 4 preferably exerts only a low adhesive force between the balls 16 and the labels 4. This, therefore, preferably only minimally interferes with the output of the labels 4, but nevertheless essentially causes the labels 4 to remain adhering to the contact portion 14 of the support apparatus 12 until the labels 4 can be removed from the support apparatus 12, either manually, or by some other type of receiving device (not shown).

Figure 2:
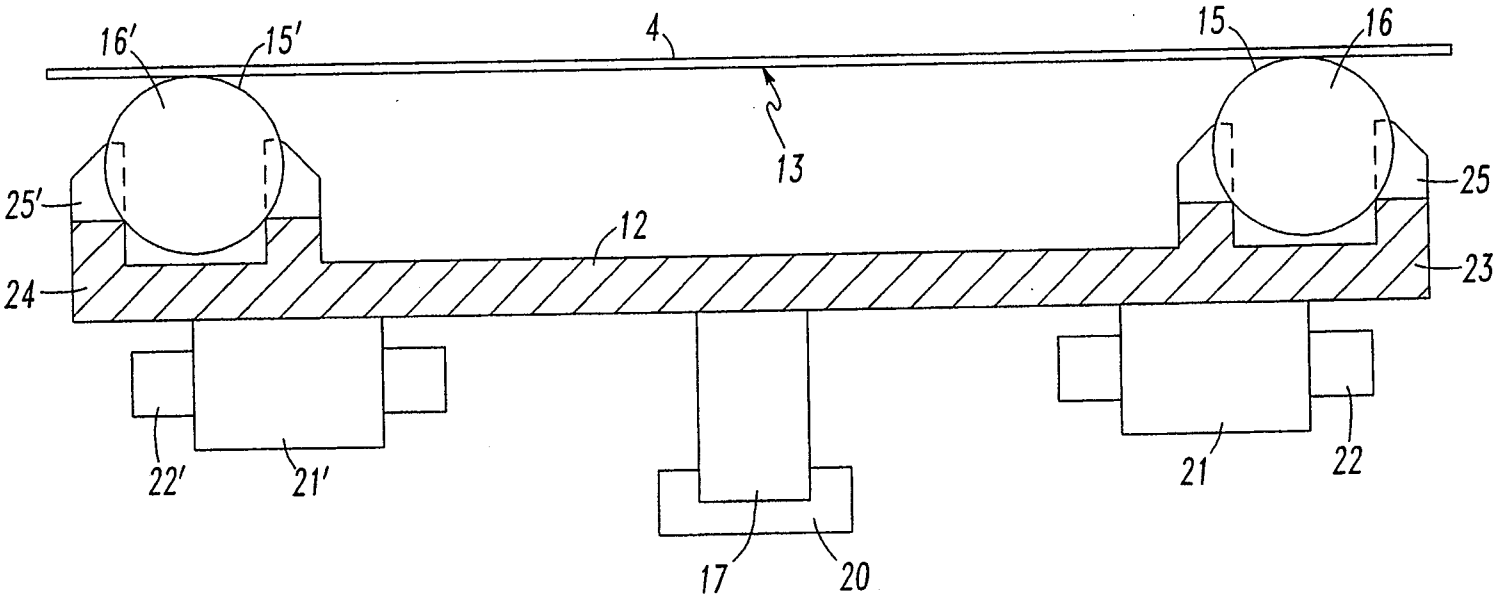
FIG. 2 illustrates the support apparatus in cross section along Line II—II in FIG. 1.

FIG. 2 is a cross section of the support apparatus 12 taken along Line II—II in FIG. 1. In general, FIG. 2 shows the retaining strips 23, 24 for the rotatably mounted balls 16, 16' located along both edges of the support apparatus 12. The label 4 is in contact with its underside 13, which is coated with the adhesive glue, on the exposed surfaces 15, 15' of the balls 16 16'. FIG. 2 also shows holes 25, 25' in the retaining strips 23, 24, which are used to hold the balls 16, 16' (as will be explained in greater detail below). Finally, FIG. 2 also shows the arm 17, the projection 20, the two brackets 21, 21' and the two lug-shaped projections 22, 22' in a plan view, which can be provided to fasten the support apparatus 12 to the printer housing 19.

Conceivably, the spacing, location and number of such retaining strips 23, 24, can preferably be variable depending on the label size. That is, if a narrower label was being printed, a support apparatus 12 could be provided which has a shorter distance between the strips 23 and 24. Further, the lengths of the strips 23 and 24 could preferably also be varied depending on the length of the label being printed. That is, for shorter labels, it might be preferable to have only three balls 16 per strip, while longer labels may preferably require a larger number of balls 16, for example, eight or nine. It could be preferable that the length of the strips 23 and 24, and the number of balls 16 therein correspond substantially to the length of the labels 4, so that the leading edge of the label 4 is relatively easy to grasp and then remove from the support apparatus 12.

Figure 3:
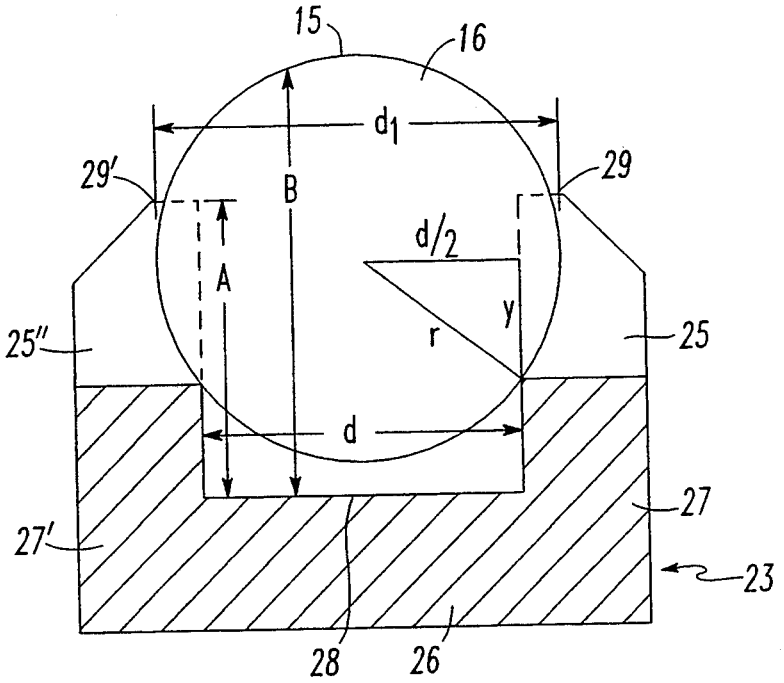
FIG. 3 illustrates a retaining strip in cross section.
Figure 4:
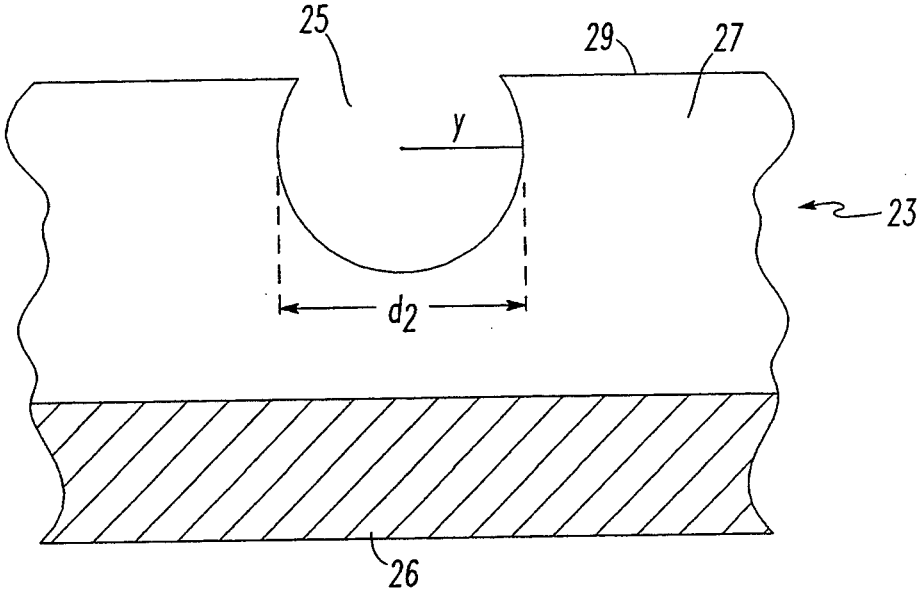
FIG. 4 is a plan view of the inside surface of a leg of the U-shaped brackets of the retaining strip with one of the holes to hold the balls.

FIG. 3 shows an enlarged cross section through one of the balls 16 and strip 23, and FIG. 4 shows an enlarged longitudinal section of the strip 23 in the vicinity of one of the balls 16 to illustrate how the balls 16 can preferably be retained by the retaining strip 23. The retaining strip 23 with a U-shaped cross section can preferably have a crossbar 26 and protruding legs 27, 27' of the U-shaped brackets on its edges. The distance (d) between the inside of the legs 27, 27' of the U-shaped brackets can preferably be slightly less than the diameter ($d_1$ or $2r$) of the balls 16 which will be inserted thereinto. The legs 27, 27' of the U-shaped brackets preferably have holes 25, 25'' opposite one another, the position of which in the legs 27, 27' of the U-shaped brackets is illustrated in FIG. 4. The diameter ($d_2$ or $2y$) of the holes 25, 25', 25'' is preferably less than the diameter ($d_1$) of the balls 16, so that the balls 16 can not pass therethrough.

So that a portion 15 of the upwardly extending surface of the balls 16 remains exposed, the distance (A) between the inside surface 28 of the crossbar 26 and the end surfaces 29, 29' of the legs 27, 27' of the U-shaped brackets should preferably be less than the distance (B) between the inside surface 28 of the crossbar 26 and at least the portion 15 of the surface of the ball 16 facing away from the crossbar 26. When designing the retaining strip 23, care must be taken, on one hand, that the holes 25, 25', 25'' are worked into the legs 27 of the U-shaped brackets so that the centers of the holes 25 lie under the end surfaces 29, 29' of the legs 27, 27' of the U-shaped brackets, and on the other hand that the radius of the holes 25, 25', 25'', radius y, can preferably be defined by the formula $y^2=(r^2-(d/2)^2)$, where r is "the radius of the ball and d is the distance of the inside surfaces of the U-legs 27, 27' from one another.

The supporting table 12, in one preferred embodiment of the present invention can preferably be made of polyoxymethylene, which has the advantage that the supporting table 12 can be manufactured using the injection molding proceeds. The balls 16 can advantageously be made of polytetrafluoroethylene, which has the characteristic that it adheres only minimally to adhesives, and can easily enable the balls 16 to be snapped between the legs 27, 27' of the U-shaped brackets of the retaining strip 23. These materials can also preferably ensure that the balls 16 will rotate within the strips 23, 24, since the use of these two materials essentially allows for substantially minimal friction resistances between the supporting table, or strips 27, 27' and the balls 16.

The fact that the retaining strips 23, 24 can preferably be manufactured from polyoxymethylene has the additional advantage that the strips 23 and 24 are thereby made particularly elastic. It is thereby possible, during assembly, to push the balls 16 from above in the vicinity of the holes 25, 25', 25'' between the elastic side walls 27, 27' of the retaining strip 23, until the balls 16 snap into the holes 25, 25', 25''.

Figure 5A:
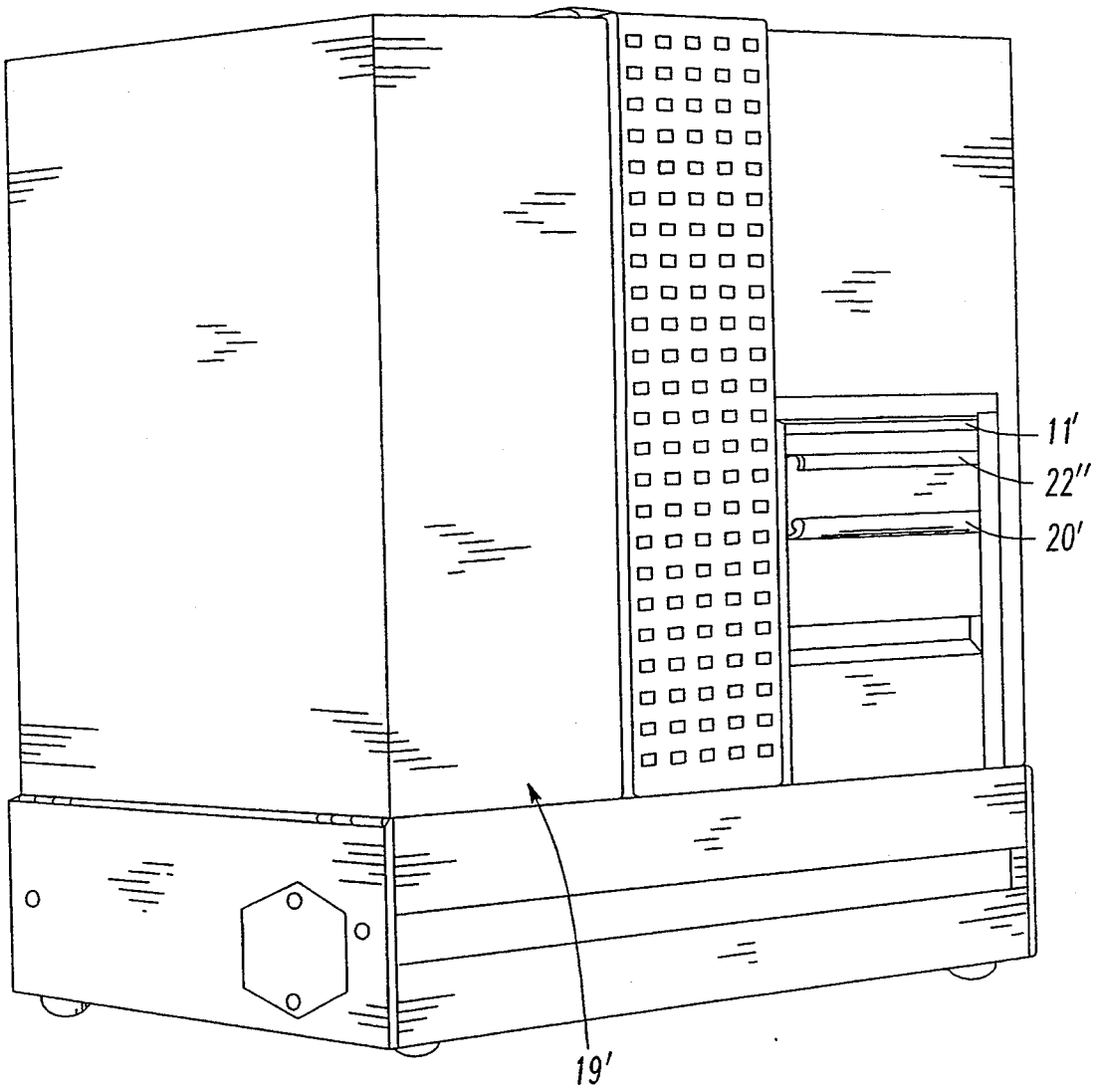
FIG. 5A illustrates one view of one type of thermal printer which could be provided with the support apparatus of the present invention.
Figure 5B:
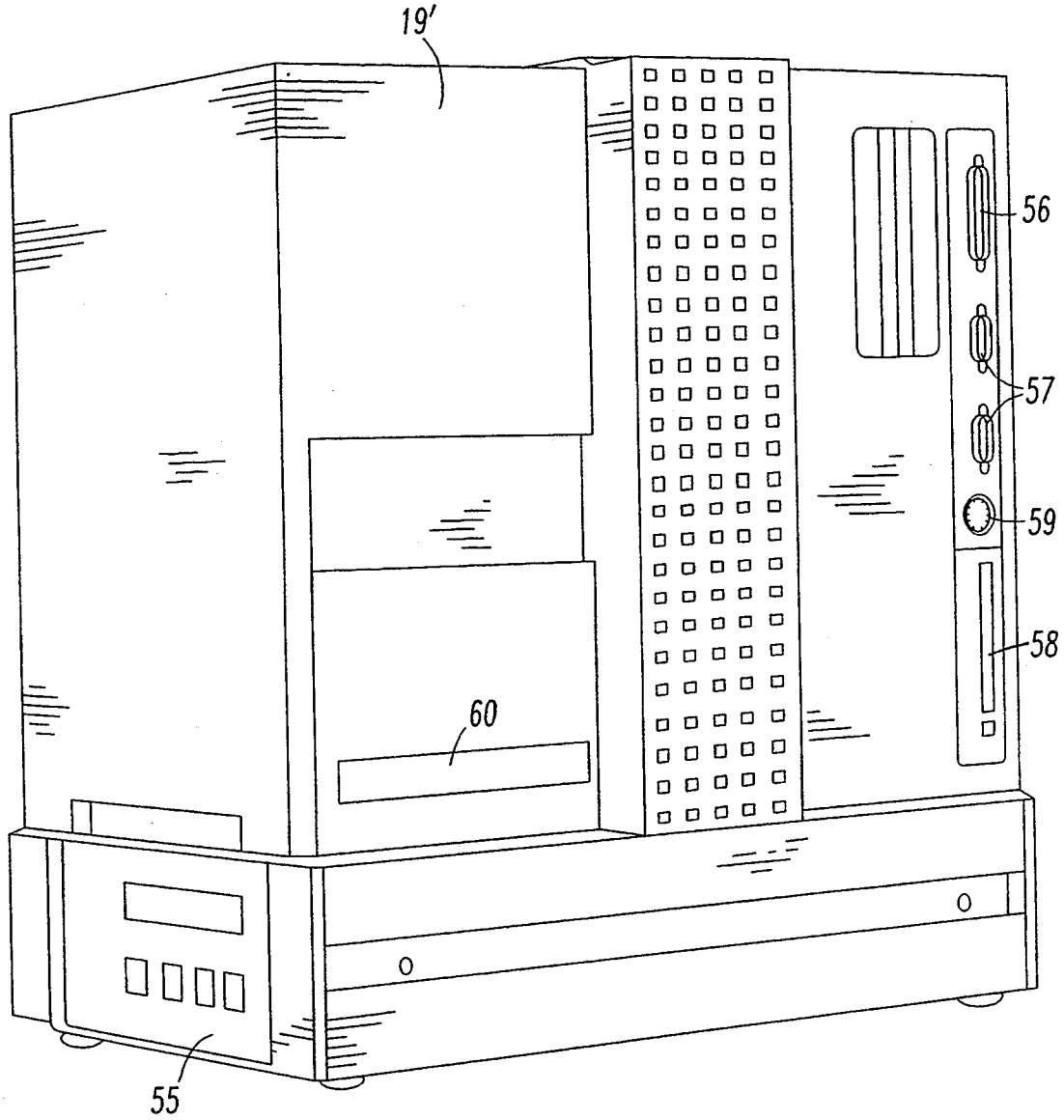
FIG. 5B illustrates another view of the thermal printer of FIG. 5A.

FIGS. 5A and 5B show one type of thermal printing device which is manufactured by the assignee of the present invention, Esselto Meto, and which is sold under the name of METO AS40, and described in more detail in the Appendix 1 attached to this patent application, and incorporated by reference herein. FIG. 5A essentially shows a front view of one embodiment of a thermal printer in accordance with the present invention. As shown in the depicted embodiment, the housing 19' can completely encase the working components of the thermal printer. The housing 19' can preferably be provided with a slot 11' for output of the printed labels from therewithin. In addition, the housing can also be provided with brackets 20' and 22'' for connecting the support apparatus thereto. FIG. 5B shows a back view of the embodiment of FIG. 5A, and shows several types of connection devices for connecting the thermal printer to external input devices for supplying control commands to the thermal printer. FIG. 5B also depicts an operator panel 55 for providing simple operation commands to the thermal printer, such as power on/off, interrupt, procede, etc. As shown in FIG. 5B, the printer can also preferably have a slot 60 for feeding label material 4, 9 thereinto, thereby allowing the printer to be fed a label supply from an external source, which supply can be a label roll as discussed previously, or a fan-fold stack of label material.

One feature of the invention resides broadly in an apparatus for printing labels 4 detachably glued by means of an adhesive on their undersides 13 to a carrier strip 9, with a printing area 1 for printing the labels 4, a deflector area 10 located behind the printing area 1 in the transport direction 3 of the labels 4, in the form of a shaft, or corrugation, or an edge, around which the carrier strip 9 can be guided, and where the labels 4 can be detached from the carrier strip 9 on account of their stiffness, whereby the adhesive remains on the underside of the label 13, an output opening 11 for the labels 4 located behind the deflector area 10 in the transport direction 3 of the labels 4, and with a support apparatus 12 with a contact area 14, with which the labels 4 detached from the carrier strip 9 and output via the output opening 11 come into contact by means of their underside 13, characterized by the fact that the contact area 14 of the contact device 12 is formed by the exposed surfaces 15 of balls 16 mounted so that they can rotate in at least one retaining strip 23, 24.

Another feature of the invention resides broadly in the apparatus for printing labels characterized by the fact that the at least one retaining strip 23, 24 has a U-shaped cross section with elastic legs 27, 27' of U-shaped brackets located on a crossbar 26, the distance between which is less than the diameter of the ball, and which have holes 25, 25'' opposite one another with a radius which is less than the radius of the ball, whereby the distance of the legs 27, 27' of the U-shaped brackets from one another and the location and the radius of the holes 25, 25', 25'' are selected so that a ball 16 is mounted between each two holes, and so that the distance between the crossbar 26 and at least a portion of the exposed surfaces 15 of the balls 16 facing away from the crossbar 26 is greater than the distance between the crossbar 26 and the end faces 29, 29' of the legs 27, 27' of the U-shaped brackets facing away from the crossbar 26.

Yet another feature of the invention resides broadly in the apparatus for printing labels characterized by the fact that the support apparatus 12 has at least two retaining strips 23, 24 for balls 16, 16' oriented in the transport direction 3 of the labels 4.

Still another feature of the invention resides broadly in the apparatus for printing labels characterized by the fact that the retaining strips 23, 24 and/or the balls 16, 16' are made of plastic.

A further feature of the invention resides broadly in the apparatus characterized by the fact that the balls 16, 16' are made of a plastic which does not stick to adhesive.

Another feature of the invention resides broadly in the apparatus characterized by the fact that the balls 16, 16' are made of polytetrafluoroethylene.

Yet another feature of the invention resides broadly in the apparatus characterized by the fact that the retaining strips 23, 24 are made of a material which exhibits only 8 small frictional resistance to the rotational movements of the balls which are made of polytetrafluoroethylene.

Still another feature of the invention resides broadly in the apparatus characterized by the fact that the retaining strips 23, 24 are made of polyoxymethylene.

Some examples of thermal printers and the components thereof which could be configured in accordance with the present invention are disclosed by the following U.S. Patents having Esselto Meto as the assignee thereof: U.S. Pat. No. 5,160,943 to Pettigrew et al , entitled "Printing Systems"; U.S. Pat. No. 5,055 858 to Koch, entitled "Thermal Printing Head"; and U.S. Pat. No. 5,023,628 to Koch, entitled "Thermal Head Mounting/Positioning Assembly".

In addition, German Laid Open Patent applications P 42-20 003.2 and 42-13 495, corresponding to U.S. patent applications Ser. No. 08/079,121 and Ser. No. 08/049,846 now U.S. Pat. No. 5,235,702, also to assignee Esselto Meto, disclose an additional thermal printer and a type of label which could be utilized in conjunction with the present invention.

Another type of labelling device which could possibly be configured with a label support apparatus in accordance with the present invention includes portable hand-held labelling devices such as the labelling device disclosed by U.S. Pat. No. 5,258,090 to assignee Esselto Meto, assignee of the present application. This labelling device comprises an inking unit for applying ink to a label, rather than a thermal print head, but hand-held labelling devices having thermal print heads are also known and could be provided with the label support apparatus in accordance with the present invention.

Some additional examples of hand-held labeling devices which could be configured in accordance with the present invention are disclosed by the following U.S. Patents: U.S. Pat. No. 4,807,177 to Ward, entitled "Multiple Format Hand-Held Label Printer"; and U.S. Pat. No. 5,061,947 to Morrison and Wirrig, entitled "Microprocessor Controlled Thermal Printer".

Some examples of the types of labels which can be used, or printed in a printing apparatus in accordance with the present invention are disclosed by the following U.S. Patents: U.S. Pat. No. 5,135,125 to Andel and Adams, directed to labels for intravenous feeding bottles; U.S. Pat. No. 5,284,688 to Hiatt, directed to laminated labels for workpieces such as bottles, etc.; U.S. Pat. No. 5,290,067 to Langen, directed to window stickers for pricing, options and fuel economy information for automobiles; and other types of labels could include appliance labels depicting cost of operation features, prescription labels for drug bottles indicating pertinent drug, dosage, and physician information, labels such as are used at golf courses or ski resorts indicating that the bearer thereof has paid for usage rights, pricing labels for retail outlets, mailing or shipping labels for commercial and retail packages, etc.

Some examples of pressure-sensitive adhesive labels with a silicon based carrying strip which can be utilized in conjunction with the present invention are disclosed by the following U.S. Patents: U.S. Pat. No. 5,073,422 to Konno and Kishita, entitled "Pressure-Sensitive Adhesive Structure"; U.S. Pat. No. 5,013,088 to Marin, entitled "Disintegratable Masking Label"; and U.S. Pat. No. 4,743,474 to Homan, entitled "Coating Process and Moisture-Curable Organopolsiloxane Compositions Therefor".

Some examples of input systems which can be used in conjunction with the present invention to input control commands for operating the printing apparatus are disclosed by the following U.S. Patents: U.S. Pat. No. 4,807,177 to Ward, entitled "Multiple Format Hand-Held Label Printer"; U.S. Pat. No. 4,757,329 to Sato et al. entitled "Desk-Top Thermal Printer"; U.S. Pat. No. 4,996,539 to Haraga et al., entitled "Label Printer"; U.S. Pat. No. 5,227,616 to Lee, entitled "Barcode Information Recognizing and Processing Method"; U.S. Pat. No. 5,166,500 to Yoon and Yoon, entitled "Barcode Reader Decoder System"; and U.S. Pat. No. 5,126,544 to Izumi, entitled "Bar Code Reader".

One additional example of friction reducing materials which could be used in accordance with the present invention for the balls, or the retaining strips is disclosed by U.S. Pat. No. 5,271,679 to Yamazumi et al., entitled "Rolling Element Bearing".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 13 013, filed on Apr. 19, 1993, having inventors Ulf Koch and Peter Schneiderf and DE-OS P 43 13 013 and DE-PS P 43 13 013, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for printing labels, the labels having a first side thereof at least partially coated with adhesive, and the labels being detachably glued by means of the adhesive to a carrier strip, said apparatus comprising:

a printing area for printing the labels;

a deflector area located behind the printing area in a transport direction of the labels, in the form of a shaft or an edge, around which the carrier strip can be guided, and where the labels can be detached from the carrier strip on account of their stiffness, whereby the adhesive remains on the underside of the label;

an output opening for the labels located behind the deflector area in the transport direction of the labels, and with a support apparatus with a contact area, with which the labels detached from the carrier strip and outpost via the output opening come into contact by means of their underside, characterized by the fact that the contact area of the contact device is formed by the exposed surfaces of balks mounted so that they can rotate in at least one retaining strip.

2. The apparatus for printing labels according to claim 1, wherein the at least one retaining strip has a U-shaped cross section with elastic legs of U-shaped brackets located on and extending from a crossbar, the distance between which legs is less than the diameter of the ball, and which have holes opposite one another with a radius which is less than the radius of the ball, whereby the distance of the legs of the U-shaped brackets from one another and the location and the radii of the holes are selected so that a ball is mounted between each two holes, and so that the distance between the crossbar and at least a portion of the exposed surfaces of the balls facing away from the crossbar is greater than the distance between the crossbar and the end faces of the legs of the U-shaped brackets facing away from the crossbar.

3. The apparatus for printing labels as claimed in claim 2, wherein the support apparatus has at least two retaining strips for balls oriented in the transport direction of the labels.

4. The apparatus for printing labels as claimed in claim 3, wherein the retaining strips and/or the balls are made of plastic.

5. The apparatus for printing labels as claimed in claim 4, wherein the balls are made of a plastic which does not stick to adhesive.

6. The apparatus for printing labels as claimed in claim 5, wherein the balls comprise at least an external coating of polytetrafluoroethylene.

7. The apparatus for printing labels as claimed in claim 6, wherein the retaining strips comprise a material which exhibits only a small frictional resistance to the rotational movements of the balls which are made of polytetrafluoroethylene.

8. The apparatus as claimed in claim 7, wherein the retaining strips comprise polyoxymethylene.

9. Apparatus for printing labels, the labels having a first side thereof at least partially coated with adhesive, said apparatus comprising:

label supply means for supplying labels to be printed;

means for printing the labels;

means for feeding labels from said label supply means to said printing means;

means for receiving printed labels from said printing means;

means for transporting printed labels from said printing means to said receiving means, said means for transporting defining a path of transport from said printing means to said receiving means and said transport path defining a direction of transport; said receiving means comprising:

a plurality of balls, said balls comprising a material having minimal adhesion characteristics to the adhesive;

means for rotatably mounting each of said plurality of balls in an area after said printing means in the direction of transport of the printed labels; and at least one of said plurality of balls being disposed for contacting adhesive of the first side of a printed label for retaining a printed label.

10. The apparatus according to claim 9, wherein: each of said plurality of balls has a diameter;

said means for mounting comprises a U-shaped member, said U-shaped member comprising:

a base portion;

first and second leg portions extending from said base portion, said first and second leg portions being disposed in a spaced apart relation to one another, said first and second leg portions each having an inner surface disposed towards the inner surface of the other of said first and second leg portions, and said inner surfaces of said first and second leg portions define a first distance therebetween;

said diameter of said balls being greater than said first distance;

each of said first and second leg portions comprising a recessed area, said recessed area of each of said first and second leg portions being disposed in alignment with the recessed area of the other of said first and second leg portions; and said aligned recessed areas of said first and second leg portions being configured for receiving and retaining one of said plurality of balls therein.

11. The printing apparatus according to claim 10, wherein:

said means for receiving comprises at least one U-shaped strip, said at least one U-shaped strip defining a longitudinal dimension, and said at least one U-shaped strip being disposed with the longitudinal dimension thereof substantially parallel to the path of travel of the printed labels;

said at least one U-shaped strip comprising a plurality of substantially aligned recesses for receiving a plurality of said balls therein.

12. The printing apparatus according to claim 11, wherein said at least one U-shaped strip has a length, and the length of said at least one U-shaped strip substantially corresponds to a length of a label.

13. The printing apparatus according to claim 12, wherein:

said printing apparatus is configured for printing on labels having variable lengths;

said printing apparatus comprises means or detachably mounting said at least one U-shaped strip substantially adjacent said printing means;

said at least one U-shaped strip being replaceable with another U-shaped strip of a length different from the length of said at least one U-shaped strip to substantially correspond the length of the at least one U-shaped strip with the length of the label.

14. The printing apparatus according to claim 13, wherein:

said at least one U-shaped strip comprises at least first and second U-shaped strips disposed substantially parallel to one another in the direction of travel of the printed labels;

said at least first and second U-shaped strips being disposed in a spaced apart relationship to one another to define a second distance therebetween;

the label having a width dimension; and said second distance between said at least first and second U-shaped strips being less than the width of the label.

15. The printing apparatus according to claim 14, wherein:

said printing apparatus comprises a housing for housing said printing means;

said housing having an opening substantially adjacent said printing means, said opening being configured for feeding printed labels therethrough from said printing means to said receiving means;

said means for detachably mounting comprises bracket means disposed adjacent said opening;

said bracket means comprises first and second hook-shaped projections extending from said housing; and said means for receiving comprises flange means for engaging said first and second hook-shaped projection.

16. The printing apparatus according to claim 15, wherein said balls and said at least first and second U-shaped strips comprise plastic.

17. The printing press according to claim 16, wherein said balls comprise polytetrafluoroethylene and said at least first and second U-shaped strips comprise polyoxymethylene.

* * * * *

UNITED STATES PATENT AND TRADEMARK OFFICE

CERTIFICATE OF CORRECTION

PATENT NO. : 5,395,174

DATED : March 7, 1995

INVENTOR(S) : Ulf KOCH and Peter SCHNEIDER

It is certified that error appears in the above-indentified patent and that said Letters Patent is hereby corrected as shown below:

In column 4, line 50, after 'achieve', delete "goo," and insert --good--.

In column 4, line 58, after the first occurrence of 'shaft', delete "4'" and insert --44'--.

In column 6, line 10, after 'strip' insert --9--.

In column 6, line 24, after 'of', delete "8" insert --a--.

In column 10, line 24, after 'Moisture-Curable', delete "Organopolsiloxane" and insert --Organopolysiloxane--.

In column 10, line 60, after 'Peter', delete "Schneiderf" and insert --Schneider,--.

In column 11, line 32, Claim 1, after 'of', delete "balks" and insert --balls--.

UNITED STATES PATENT AND TRADEMARK OFFICE

CERTIFICATE OF CORRECTION

PATENT NO. : 5,395,174

DATED : March 7, 1995

INVENTOR(S) : Ulf KOCH and Peter SCHNEIDER

It is certified that error appears in the above-indentified patent and that said Letters Patent is hereby corrected as shown below:

In column 11, line 42, Claim 2, after the second occurrence of 'the', delete "radii" and insert --radius--.

Signed and Sealed this

Twenty-fourth Day of December, 1996

*Attest:*

Bruce Lehman

BRUCE LEHMAN

*Attesting Officer*

*Commissioner of Patents and Trademarks*